US012320135B2

(12) United States Patent
Ledford et al.

(10) Patent No.: US 12,320,135 B2
(45) Date of Patent: Jun. 3, 2025

(54) RACK APPARATUS

(71) Applicant: Bil-Jax, Inc., Archbold, OH (US)

(72) Inventors: Chris Ledford, Edon, OH (US); Mark Wagner, Archbold, OH (US)

(73) Assignee: Bil-Jax, Inc., Archbold, OH (US)

( * ) Notice: Subject to any disclaimer, the term of this patent is extended or adjusted under 35 U.S.C. 154(b) by 403 days.

(21) Appl. No.: 17/819,665

(22) Filed: Aug. 15, 2022

(65) Prior Publication Data

US 2023/0064354 A1 Mar. 2, 2023

Related U.S. Application Data

(60) Provisional application No. 63/260,709, filed on Aug. 30, 2021.

(51) Int. Cl.
*E04G 5/00* (2006.01)

(52) U.S. Cl.
CPC ..... *E04G 5/004* (2013.01)

(58) Field of Classification Search
CPC ..... E04G 5/004; E04G 1/15; B65D 19/44; B62B 3/02; B62B 3/10
See application file for complete search history.

(56) References Cited

U.S. PATENT DOCUMENTS

| | | | | |
|---|---|---|---|---|
| 2,882,100 | A | 4/1959 | Bank | |
| 4,598,794 | A | 7/1986 | Anderson | |
| 4,901,650 | A * | 2/1990 | Armstead | B65D 19/08 211/186 |
| 6,116,533 | A | 9/2000 | Elder | |
| 6,123,208 | A | 9/2000 | Haenszel | |
| 6,270,094 | B1 | 8/2001 | Campbell | |
| 6,422,405 | B1 | 7/2002 | Haenszel | |
| 6,523,776 | B1 | 2/2003 | Elder | |
| 6,910,591 | B2 | 6/2005 | Knoll et al. | |
| 7,185,899 | B2 | 3/2007 | Thiede et al. | |
| 7,591,497 | B2 | 9/2009 | Johns | |
| 7,878,338 | B2 | 2/2011 | Maxson | |
| 8,459,412 | B2 | 6/2013 | Nickel et al. | |
| 8,714,369 | B2 | 5/2014 | Liu et al. | |
| 8,752,716 | B2 | 6/2014 | Gibson et al. | |
| 8,919,582 | B1 | 12/2014 | Kmetz, III et al. | |
| 9,370,969 | B2 * | 6/2016 | Kroening | B60B 33/0018 |
| 9,546,889 | B2 | 1/2017 | Sue et al. | |
| 9,920,540 | B2 | 3/2018 | Kurtz | |
| 9,932,058 | B2 | 4/2018 | Holloway et al. | |
| 10,597,057 | B1 | 3/2020 | Hilmerson | |
| 10,815,681 | B2 | 10/2020 | Kurtz | |
| 10,843,718 | B1 | 11/2020 | Hilmerson | |
| 10,863,646 | B1 | 12/2020 | Rampey et al. | |
| 11,034,372 | B1 | 6/2021 | Jordan et al. | |
| 2006/0054576 | A1 | 3/2006 | Durham | |
| 2011/0155740 | A1 | 6/2011 | Zintl et al. | |
| 2014/0084036 | A1 | 3/2014 | Hemann | |

FOREIGN PATENT DOCUMENTS

| | | | |
|---|---|---|---|
| WO | 2013190200 | A1 | 12/2013 |

* cited by examiner

*Primary Examiner* — Stanton L Krycinski
(74) *Attorney, Agent, or Firm* — Marshall & Melhorn, LLC

(57) ABSTRACT

A rack apparatus may have a plurality of uprights and stanchions coupled to a base, where the uprights and the stanchions may form areas configured to receive and support scaffolding and at least one working component. The base may be configured to be transported by a material handling device.

15 Claims, 5 Drawing Sheets

RACK APPARATUS

FIELD

The presently disclosed subject matter relates to a rack apparatus, and more particularly to a scaffold rack apparatus and method of using the same.

BACKGROUND

Commonly known and available scaffold is comprised of a plurality of scaffolding and associated working components, such as coupling mechanisms and walkboards, for example. Such scaffold may also have wheels so that it can be more easily moved during use from location to location.

Transporting the scaffold to an initial location, however, has been problematic. In some cases, scaffold users loosely put the scaffolding and working components in a truck bed, cargo van, or other work vehicle. Using this mode of transport, the scaffolding and working components become disorganized and may damage themselves or the vehicle.

Conventional scaffold rack systems recognize the transport problem of the scaffolding. These rack systems, however, fail to accommodate a full set of scaffolding, lack structures for carrying or storing the working components, are difficult to move, and do not adequately secure the scaffolding thereto, among other disadvantages. Further, these prior art rack systems are difficult to transport from a manufacturer to an initial customer because they comprise fully-welded frames that cannot be easily disassembled for transport.

Tool and equipment companies may also rent the rack systems to make the transport of scaffolding available to their customers. However, in addition to the disadvantages associated with the rack systems mentioned above, these companies have the additional problem that the current rack systems make it difficult to quickly and easily inspect and inventory all the scaffolding and working components as they come and go from the company.

In view of the disadvantages associated with the known rack systems, it would be advantageous for a rack apparatus to readily and easily permit inspection of all the scaffolding and working components. It would also be advantageous for the rack apparatus to be able to transport the scaffolding, working components, and accessories required for a complete scaffold, and for the rack apparatus to be easily movable from a storage location, a transport location and a work location. Further, it would be advantageous for the rack system to robustly, but selectively, secure the scaffolding, working components, and accessories compartment thereon to mitigate against damage to themselves and the transport vehicle. Additionally, it would be advantageous for the rack apparatus to be modular so it can be relatively easily and inexpensively transported from the manufacturer to the customer.

SUMMARY

In concordance and agreement with the present disclosure, a scaffold rack system, which improves transportability, durability, manufacturability, and utility has surprisingly been discovered.

In one embodiment, a rack apparatus may have a base comprising a pair of spaced apart, parallel, and at least partially hollow members. The apparatus may also have a lower perimeter frame comprising a pair of parallel outer lateral members and a pair of parallel longitudinal members, wherein said lower perimeter frame rests on said base. The apparatus may also have a pair of uprights connected to said lower perimeter frame, each upright comprised of a vertically extending first member, a horizontally extending second member, a pair of parallel vertically extending third members and a fourth member comprised of a selective locking member. The apparatus may also have a plurality of at least partially hollow vertically extending receiving elements connected to one of said longitudinal members. The apparatus may also have at least one inner lateral member connected to said base. The apparatus may also have an at least partially hollow rack connected to said at least one inner lateral member, said rack comprising vertically extending side members and at least one horizontally extending rail connecting the side members. The apparatus may also have a pair of at least partially hollow stanchions connected to said at least one inner lateral member, said stanchions are parallel to said vertically extending side members.

BRIEF DESCRIPTION OF THE DRAWINGS

The above, as well as other advantages of the present device, will become readily apparent to those skilled in the art from the following detailed description when considered in the light of the accompanying drawings in which.

DETAILED DESCRIPTION

Figure 1:
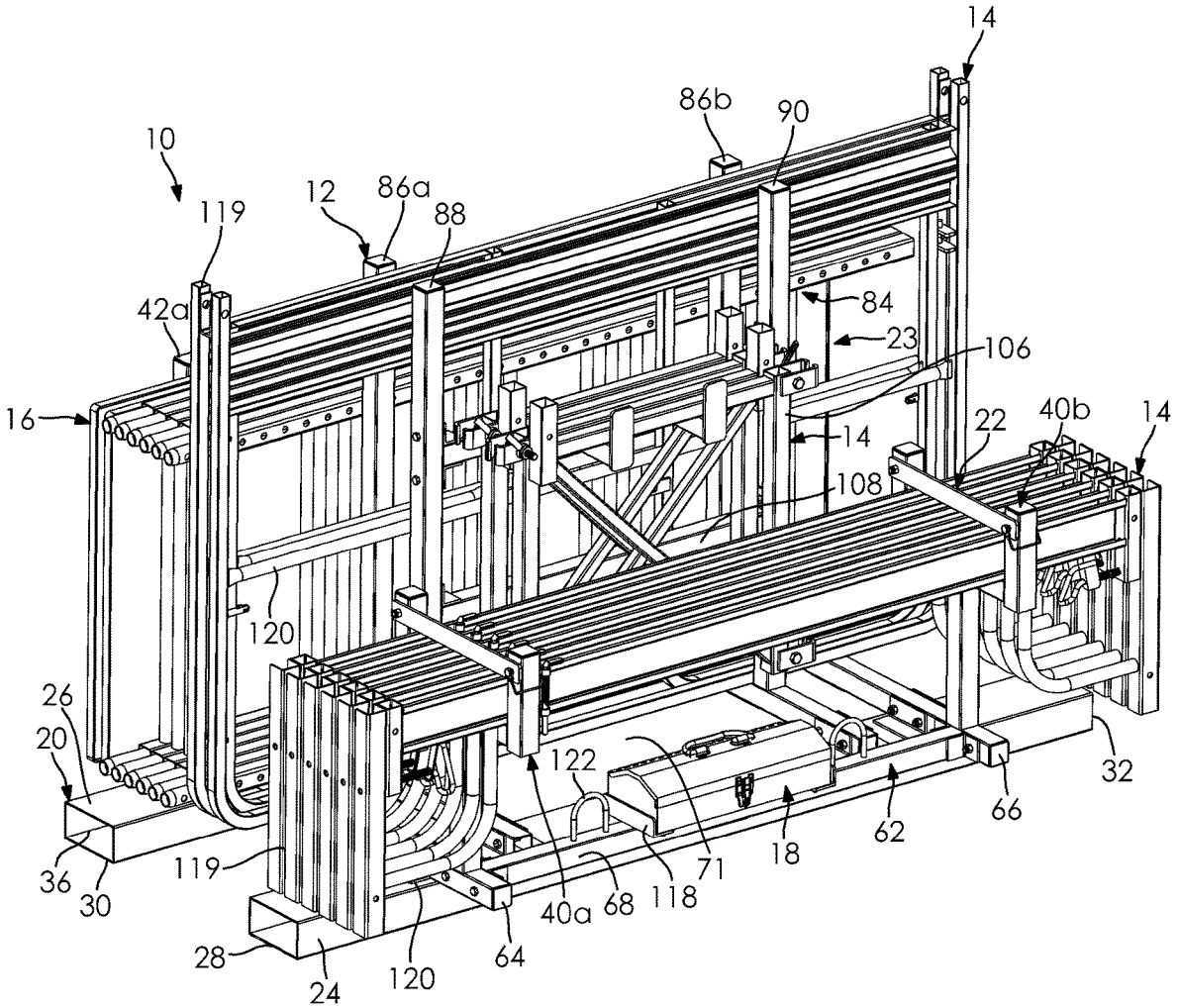
FIG. 1 is a front perspective view of a scaffold rack system according to an embodiment of the presently disclosed subject matter, wherein the scaffold rack system includes a rack apparatus, a plurality of scaffolding, at least one working component, and an accessories compartment.

It is to be understood that the device may assume various alternative orientations and step sequences, except where expressly specified to the contrary. It is also to be understood that the specific devices and processes illustrated in the attached drawings, and described in the following specification are simply exemplary embodiments of the concepts. Hence, specific dimensions, directions or other physical characteristics relating to the embodiments disclosed are not to be considered as limiting.

FIGS. 1-5 illustrate a rack system 10 according to an embodiment of the presently described subject matter. The rack system 10 may include one or more of a rack apparatus 12 configured to releasably support and transport a plurality of scaffolding 14, at least one working component 16 (e.g. walkboards, casters, etc.), and an accessories compartment 18. It is understood, however, that the rack system 10 may be used in other applications to support and transport various articles and components as desired. In certain embodiments, the rack apparatus 12 includes a base 20, a rigid first support portion 22, and a rigid second support portion 23 coupled to the base 20. Each of the support portions 22, 23 forms an area for storing and securing the scaffolding 14, the at least one working component 16, and the accessories compartment 18. It is understood that the rack apparatus 12 may include greater or fewer frame support portions as desired to accommodate more or less scaffolding 14, working components 16, and accessories. The rack apparatus 12 may be constructed for any suitable and robust material such as metal, wood, composite materials, plastics, and the like, for example. Preferably, the rack apparatus 12 is constructed of steel as it has high strength, is relatively inexpensive and readily available and capable of withstanding harsh working and environmental conditions.

As illustrated, the base 20 includes a pair of spaced apart and generally parallel elongate members 24, 26. The elongate member 24, 26 are spaced apart at a distance to correspond to a distance between manipulating components of a material handling device (not depicted) (e.g. forks of a forklift truck). For example, the distance between manipulating components of the material handling device may be spaced apart in a range of about zero inches (0.0") to about seventy-two inches (72"). Accordingly, the elongate member 24 may be spaced apart from the elongate member 26 at a distance in a range of about zero inches (0.0") to about seventy-two inches (72"). Preferably, the distance between the elongate members 24, 26 is in a range of about twenty-four inches (24") to about forty-eight inches (48"). It is understood that each of the frame portions 22 may be releasably and/or movably coupled to the base 20, and more particularly the elongate members 24, 26, to permit the distance between the elongate members 24, 26 of the base 20 to be adjusted as desired.

Each of the elongate members 24, 26 includes respective first ends 28, 30 and second ends 32, 34. As illustrated, the elongate members 24, 26 are positioned such that the end 28 of the elongate member 24 is aligned with the end 30 of the elongate member 26. Similarly, the end 32 of the elongate member 24 is aligned with the end 34 of the elongate member 26. In certain embodiments, each of the ends 28, 30, 32, 34 may be configured to receive one of the manipulating components of the material handling device. Although the elongate members 24, 26 shown have a rectangular cross-sectional shape with a hollow interior portion 36, it is understood that the elongate members 24, 26 may have any cross-sectional shape as desired such as elliptical, triangular, circular, square, and the like, or any irregular cross-sectional shape, for example.

As more clearly illustrated in FIGS. 3-6, the first support portion 22 may include a pair of opposing uprights 40*a*, 40*b* and a pair of opposing stanchions 42*a*, 42*b*. The first support portion 22 may include more or less uprights 40*a*, 40*b* and stanchions 42*a*, 42*b* than shown. The uprights 40*a*, 40*b* are configured to releasably receive and support at least one piece of the scaffolding 14 thereon and the stanchions 42*a*, 42*b* are configured to receive and support at least a portion of the working components 16 thereon. The uprights 40*a*, 40*b* and the stanchions 42*a*, 42*b* may be constructed of tubular members having any suitable cross-sectional shape such as square, rectangular, elliptical, triangular, circular, irregular, and the like, for example. It should also be appreciated that the tubular members of the uprights 40*a*, 40*b* and the stanchions 42*a*, 42*b* may be hollow to reduce weight of the rack apparatus 12.

In certain embodiments, the uprights 40*a*, 40*b* are generally wishbone shaped. Each of the uprights 40*a*, 40*b* may be comprised of respective vertically extending first members 44*a*, 44*b*, horizontally extending second members 46*a*, 46*b* disposed on an upper end of the first members 44*a*, 44*b*, and a pair of parallel, vertically extending third members 48*a*, 48*b* and fourth members 50*a*, 50*b* disposed at opposing distal first ends 52*a*, 52*b* and second ends 54*a*, 54*b* of the second members 46*a*, 46*b*.

Each of the uprights 40*a*, 40*b* may further include respective locking mechanisms 56*a*, 56*b* to releasably secure at least a portion of the scaffolding 14 to the uprights 40*a*, 40*b*. In some embodiments, the locking mechanisms 56*a*, 56*b* comprise respective locking arms 58*a*, 58*b* and lockers 60*a*, 60*b* (e.g. a cotter pin). The locking arms 58*a*, 58*b* shown have one end movably coupled to one of the third members 48*a*, 48*b* and the fourth members 50*a*, 50*b* and another end releasably secured to the remaining one of the third members 48*a*, 48*b* and the fourth members 50*a*, 50*b* by the lockers 60*a*, 60*b*.

As illustrated, the uprights 40*a*, 40*b* and the stanchions 42*a*, 42*b* may be releasably or permanently secured to a lower perimeter frame 62. The releaseable securement may be achieved through mechanical fasteners and brackets. Use of the mechanical fasteners and the brackets may be preferred as it permits the uprights 40*a*, 40*b* and the stanchions 42*a*, 42*b* to be disassembled from the lower perimeter frame 62 for adjustment, shipping, and transport.

The lower perimeter frame 62 may be comprised of a plurality of members that may be connected together to form a generally rectangular shape. In one embodiment, the lower perimeter frame 62 includes a pair of parallel lateral members 64, 66 and a pair of parallel longitudinal members 68, 70. The lateral and longitudinal members 64, 66, 68, 70 may be coplanar. The lateral and longitudinal members 64, 66, 68, 70 may bound an open interior 71. The members 64, 66, 68, 70 of the lower perimeter frame 62 may be constructed of tubular metal members in the same or similar manner to the uprights 40*a*, 40*b* and the stanchions 42*a*, 42*b*. As shown, the lower perimeter frame 62 is coupled to the base 20 of the rack apparatus 12. In certain embodiments, the lateral members 64, 66 are releasably coupled to the base 20. The releaseable securement of the lower perimeter frame 62 may be achieved through mechanical fasteners 72 and brackets 73. Use of the mechanical fasteners 72 and the brackets 73 may be preferred as it permits the lower perimeter frame 62 to be selectively positioned and/or disassembled from the base 20 for adjustment, shipping, and transport.

One of the longitudinal members 68, 70 may include at least one receiving element 74 coupled thereto. The at least one receiving element 74 may extend transverse the primary direction of the one of the longitudinal member 68, 70. Preferably, a plurality of receiving elements 74 are coupled to the longitudinal member 70. The receiving elements 74 may be aligned and arranged in a linear array having each of the receiving elements 74 equally spaced from one another other along the longitudinal member 70. Thus, the receiving elements 74 may be coplanar with one another along the longitudinal member 70. In one embodiment, the receiving elements 74 may have different heights, or transverse extensions, with respect to the longitudinal member 70. The receiving elements 74 may alternate in height where a first set has a first height and a second set has a second height. The first set may all have the same height and the second set may all have the same height. It is preferred that all of the receiving elements 74 have apertures 76 extending therethrough where the apertures 76 are oriented parallel the direction of the longitudinal member 70.

Figure 2:
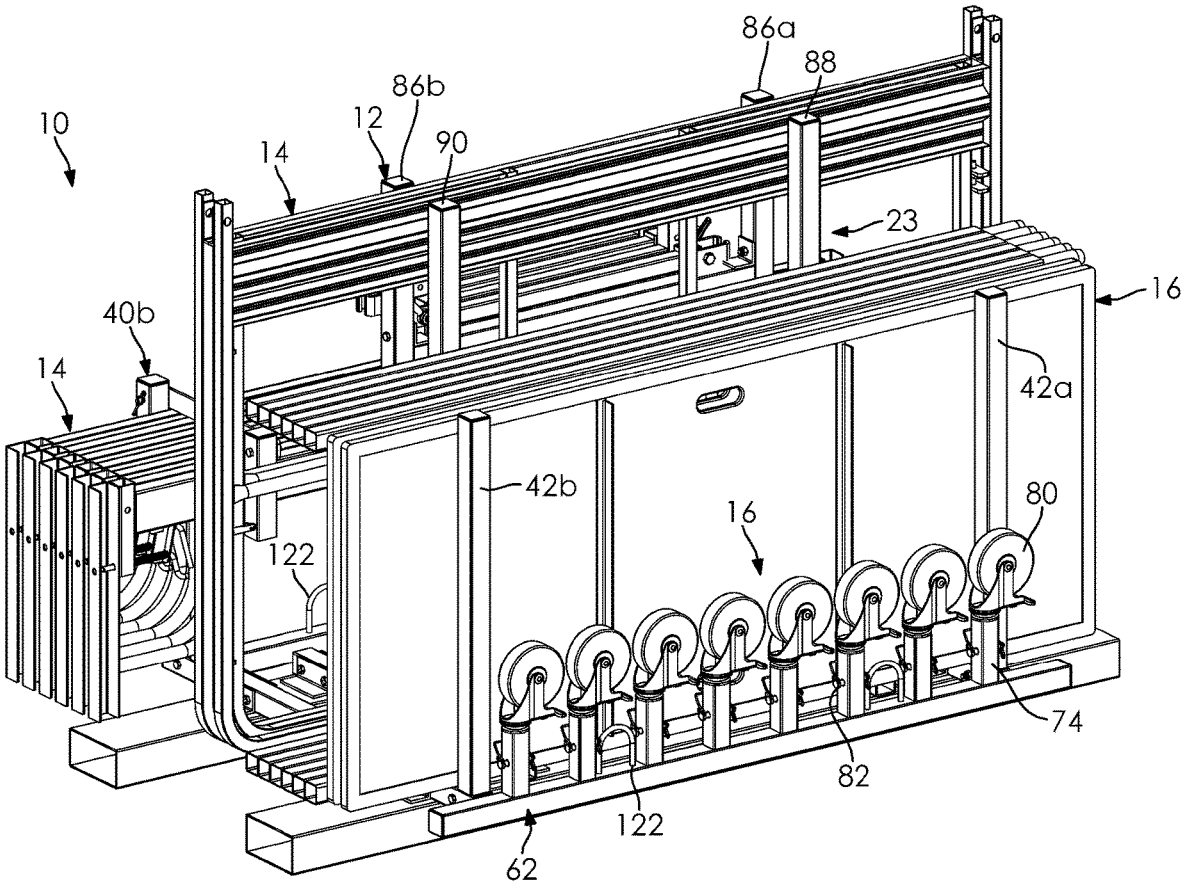
FIG. 2 is a rear perspective view of the scaffold rack system of FIG. 1.

Regardless of the height, the receiving elements 74 are configured to selectively receive at least a portion of at least one of the working components 16. In certain embodiments, each of the receiving elements 74 is configured to receive a post of a caster 80 therein, as shown in FIG. 2. A locker 82 may be employed to releasably secure the working component 16 to the receiving element 74. More particularly, the locker 82 may be used to secure the caster 80 to the receiving element 74 when the post of the caster 80 is installed in the receiving element 74. Various types of lockers 82 may be employed such as cotter pins, for example. As shown, the locker 82 may be inserted through the aperture 76 of the receiving element 74 and the portion of the working component 16 to releasably secure the working component 16 therein. Accordingly, the working components 16 may be selectively locked into and selectively removed from the receiving elements 74. In certain embodiments, a wheel portion of the caster 80 may extend above the receiving element 74. The lockers 82 may be the same lockers used to connect at least one of the working components 16, preferably the caster 80, to the scaffolding 14 when in use. Thus, the rack apparatus 12 also provides a storage location for the lockers 80 on the rack apparatus 12. Varying the heights of the receiving elements 74 permit the working components 16 to be positioned closer to one another. In certain embodiments, the heights of the receiving elements 74 are varied to militate against contact between the wheel portions of the casters 80.

Referring back to FIGS. 3-6, the second support portion 23 may include an rack 84 and a pair of opposing stanchions 86*a*, 86*b*. The second support portion 23 may include more or less racks 84 and stanchions 86*a*, 86*b* than shown. The rack 84 may be configured to releasably receive and support at least one piece of the scaffolding 14 thereon and the stanchions 86*a*, 86*b* may be configured to receive and support at least a portion of the working components 16 thereon. The rack 84 and the stanchions 86*a*, 86*b* may be constructed of tubular members having any suitable cross-sectional shape such as square, rectangular, elliptical, triangular, circular, irregular, and the like, for example. It should also be appreciated that the tubular members of the rack 84 and the stanchions 86*a*, 86*b* may be hollow to reduce weight of the rack apparatus 12.

In certain embodiments, the rack 84 may be comprised of parallel, vertically extending side members 88, 90 and parallel, horizontally extending rails 92, 94. The rails 92, 94 may extend between the side members 88, 90. The rails 92, 94 support the side members 88, 90, providing strength thereto, and extend transverse the side members 88, 90. The rails 92, 94 may be selectively attached to the side members 88, 90, such as with mechanical fasteners 96 and brackets 98. It may be preferred to selectively attach the rails 92, 94 to the side members 88, 90 to facilitate assembly/disassembly of the rack apparatus 12 for transport and shipping. The side members 88, 90 and the rails 92, 94 may be coplanar with one another. There may be more or less of the rails 92, 94 than shown in FIGS. 1-6.

As illustrated, the rail 92 may be provided with a pair of arms 100. It should be appreciated, however, that the rail 94 may include at least one arm 100 if desired. It is understood that more or less of the arms 100 shown in FIGS. 1-6 may be coupled to at least one of the rails 92, 94 if desired. The arms 100 may be permanently or releaseably attached to at least one of the rails 92, 94. In either case, it is preferred that the arms 100 extend perpendicularly, or transversely, from at least one of the rails 92, 94 in a cantilevered fashion. At least one of the arms 100 may include a curtailment member 102 on an end portion 104 thereof. It should also be appreciated that the arms 100 may also be coupled to at least one of the side members 88, 90.

As more clearly shown in FIG. 1, the arms 100 are configured to receive and support at least one piece of the scaffolding 14. In certain embodiments, the arms 100 may be used to receive and selectively support scaffold brackets 106 thereon. At least the curtailment member 102 and the end portion 104 of the arms 100 may extend through an opening 108 in the scaffold brackets 106 to selectively secure them thereto.

As illustrated, the rack 84 and the stanchions 86*a*, 86*b* may be releasably or permanently secured to a pair of inner lateral members 110, 112. The releaseable securement may be achieved through mechanical fasteners. Use of the mechanical fasteners may be preferred as it permits the rack 84 and stanchions 86*a*, 86*b* to be disassembled from the inner lateral members 110, 112 for adjustment, shipping, and transport. The inner lateral members 110, 112 may be coplanar and constructed of tubular metal members in the same or similar manner to the rack 84 and the stanchions 86*a*, 86*b*. As shown, the inner lateral members 110, 112 are coupled to the base 20 of the rack apparatus 12. In certain embodiments, the inner lateral members 110, 112 are releaseably coupled to the base 20. The releaseable securement of the inner lateral members 110, 112 may be achieved through mechanical fasteners 114 and brackets 116. Use of the mechanical fasteners 114 and the brackets 116 may be preferred as it permits the inner lateral members 110, 112 to be selectively positioned and/or disassembled from the base 20 for adjustment, shipping, and transport.

A portion of the scaffolding 14 and/or working components 16 may be received and supported in a storage area formed between the rack 84 and the stanchions 86*a*, 86*b*. Similarly, a portion of the scaffolding 14 and/or working components 16 may be received and support in a storage area formed between the stanchions 42*a*, 42*b* and the stanchions 86*a*, 86*b*. In certain embodiments, a portion of generally large scaffolding 14 is received and supported in the storage area formed between the rack 84 and the stanchions 86*a*, 86*b* and a portion of walkboards received and supported in the storage area formed between the stanchions 42*a*, 42*b* and the stanchions 86*a*, 86*b*.

Figure 3:
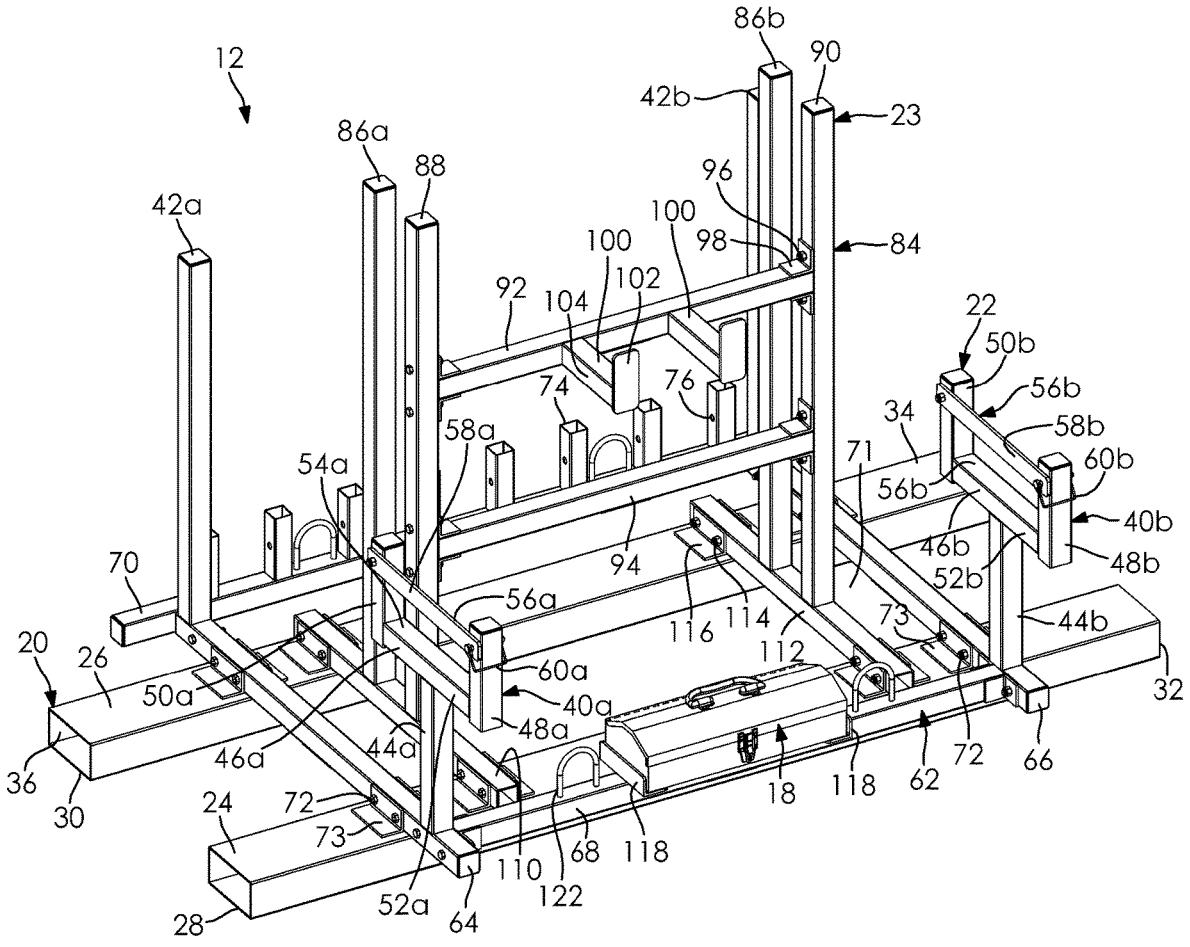
FIG. 3 is a front perspective view of the rack apparatus of the scaffold rack system of FIGS. 1-2.
Figure 4:
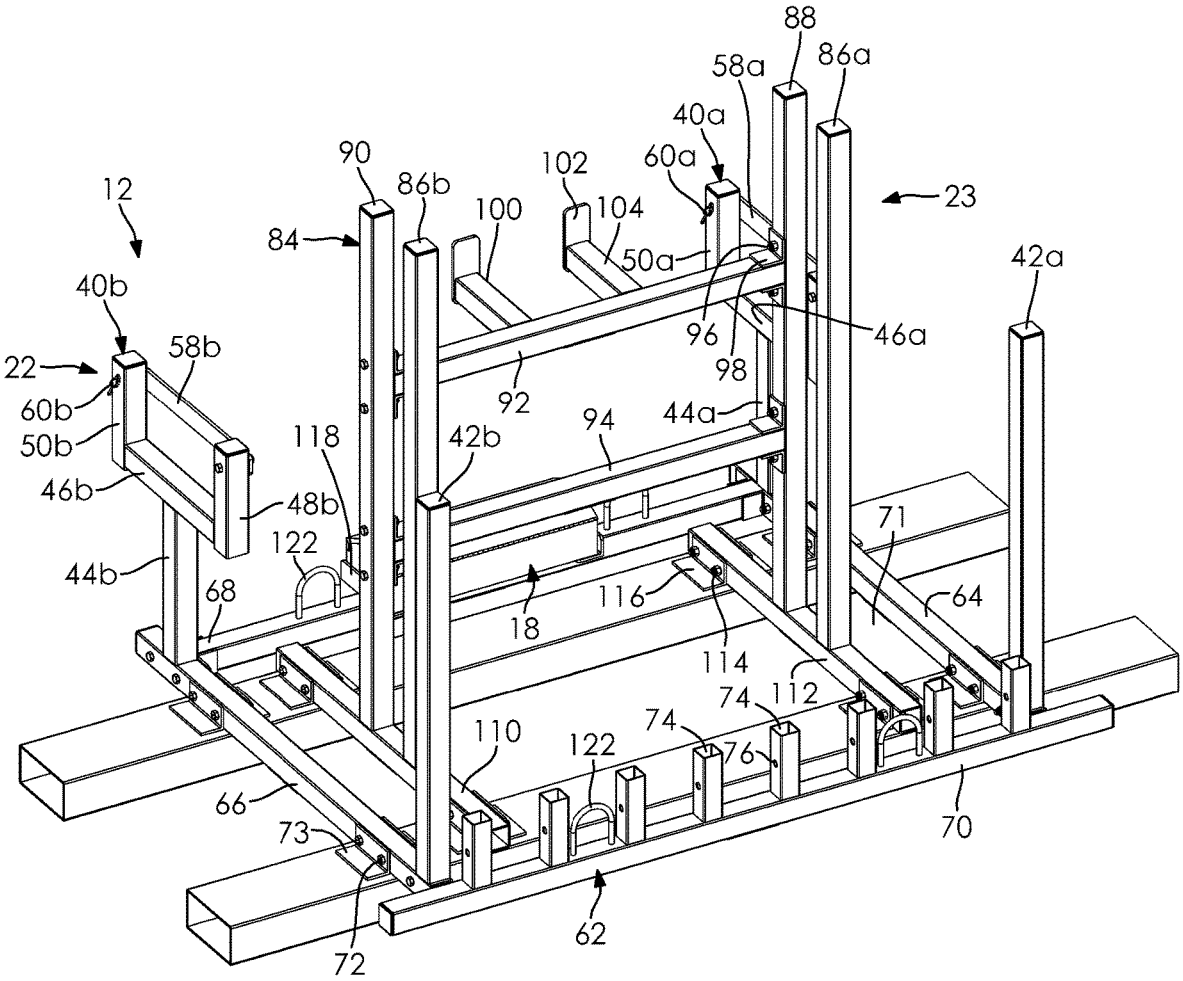
FIG. 4 is a rear perspective view of the rack apparatus of FIG. 3.
Figure 5:
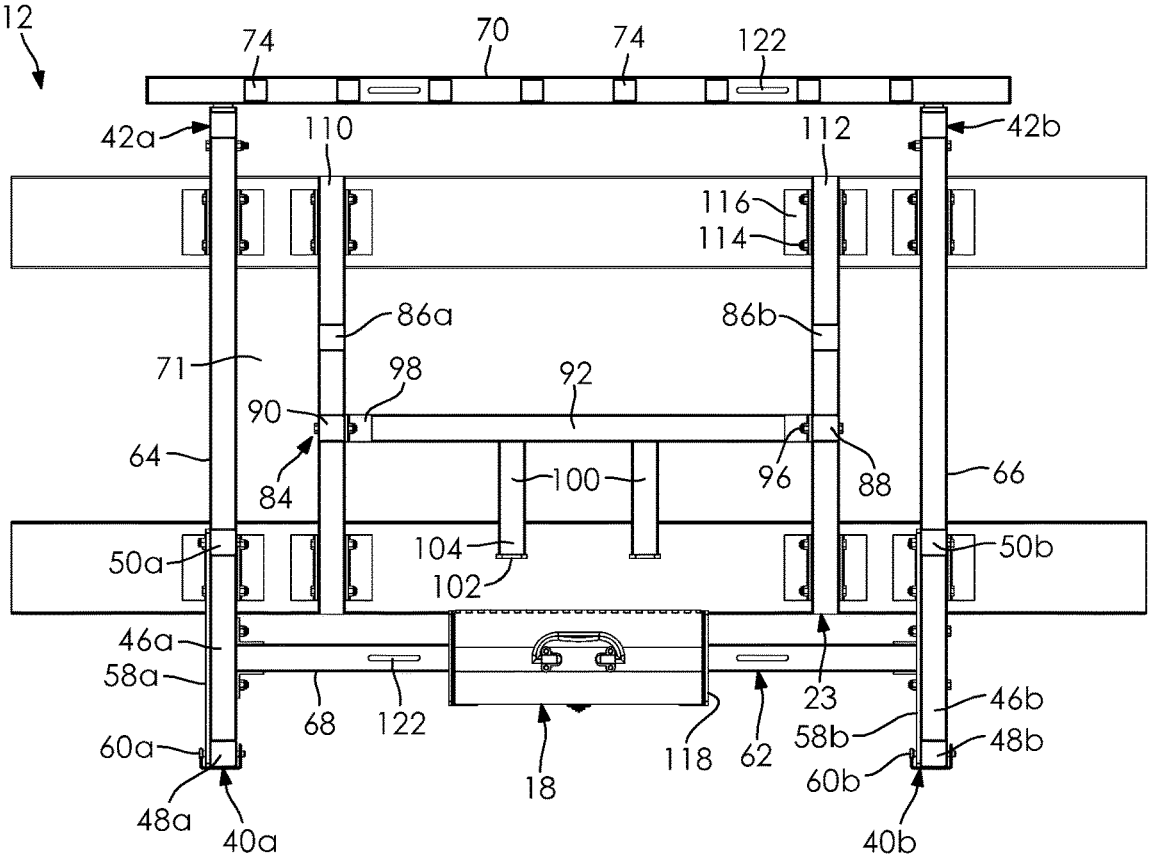
FIG. 5 is a top view of the rack apparatus of FIGS. 3 and 4.
Figure 6:
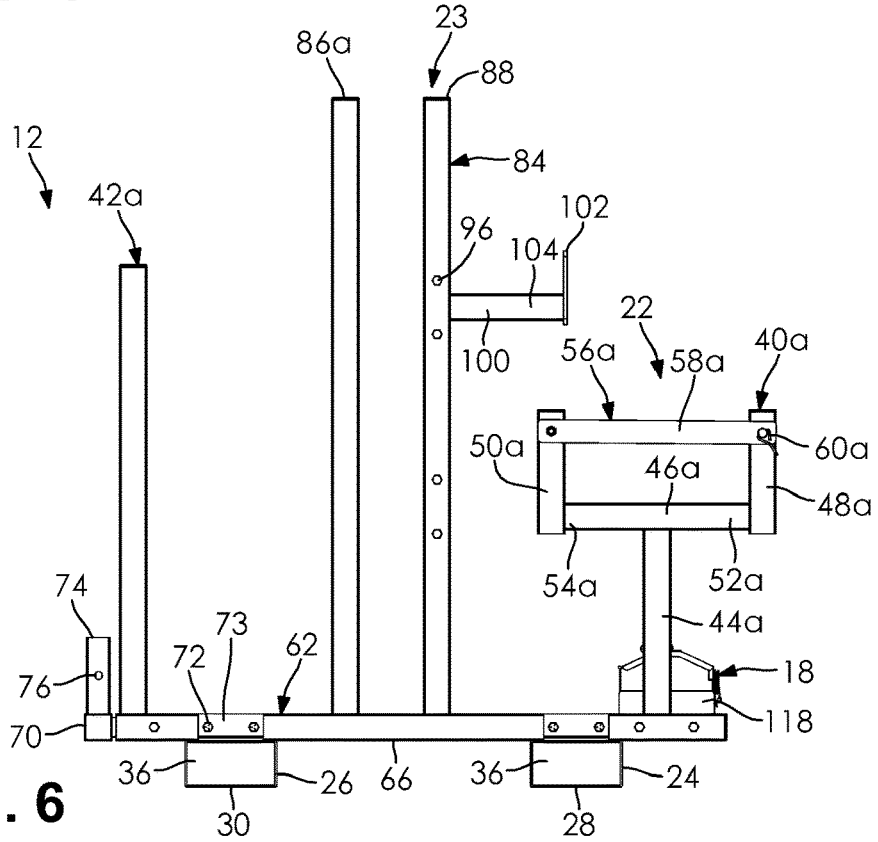
FIG. 6 is a left side view of the rack apparatus of FIGS. 3-5.

As more clearly shown in FIGS. 1 and 3, the accessories compartment 18 may be located on or adjacent the lower perimeter frame 62. Brackets 118 connected to the longitudinal member 68 may support ends of the compartment 18 from below as well. The compartment 18 may be used to hold scaffolding parts, instructions for use of the scaffolding parts or the rack apparatus, and the like. Preferably, the compartment 18 facilitates location, storage and inspection of the accessories associated with the rack system 10, the rack apparatus 12, the scaffolding 14, and working components 16 by locating them in a single location.

In certain embodiments, the scaffolding 14 may comprise scaffold frame members 119 coupled to scaffold frame tubes 120. The scaffold frame members 119 and/or the scaffold frame tubes 120 may be constructed of tubular members with hollow interiors. The scaffold frame tubes 120 may be selectively located within the scaffold frame members 119. The scaffold frame tubes 120 are located a sufficient amount into the scaffold frame members 119 so they provide sufficient support to the scaffold frame members 119 thereby permitting the scaffold frame members 119 to stand in a vertical, or near vertical, orientation on the first side without other additional supports. In this embodiment, the primary direction of the scaffold frame members 119 may be oriented parallel, or generally parallel, the primary direction of the support frame portions 22, 23 of the rack apparatus 12. It is also permissible for the scaffold frame members 119 to be located within the scaffold frame tubes 120.

As illustrated in FIGS. 1-5, the rack apparatus 12 may also have a plurality of tie downs 122. More or less tie downs 122 than shown may be employed if desired. In one embodiment, a pair of the tie downs 122 may be located on each of the longitudinal members 68, 70 of the lower perimeter frame 62. It is understand that the tie downs 122 may be disposed at other locations on the rack apparatus 12 as desired. The tie downs 122 may selectively receive tie down straps (not shown) therethrough. The straps may extend over all or part of the scaffolding 14 and the working components 16 to help secure them in place.

The tie downs 122 may be such as D-rings, but other structures having a firm connection to the rack apparatus 12 and accepting connection with one or more tie down straps may be permissible.

As can be appreciated from the foregoing, the rack apparatus 12 can be readily loaded and unloaded by a single worker. The rack system 10 can be located in a transport vehicle with a forklift by a single worker. This is highly advantageous over the known rack designs which require multiple workers, which tie up resources and cost more money to use and operate. Further, the rack system 10, including the rack apparatus 12, the scaffolding 14, the working components 16, and the accessories compartment 18, is still compact enough that it fits within a pick-up truck bed or trailer, which makes it highly portable.

It can further be appreciated that the rack apparatus 12 described and depicted herein can accommodate a full set of scaffolding 14 and working components 16 and other associated accessories in an organized and secured manner. Further, the rack apparatus 12 leaves all of the scaffolding 14 and working components 16 exposed so they can be readily accessed and ready for observation/check.

In accordance with the provisions of the patent statutes, the present device has been described in what is considered to represent its preferred embodiments. However, it should be noted that the invention can be practiced otherwise than as specifically illustrated and described without departing from its spirit or scope.

What is claimed is:

1. A rack apparatus, comprising:

a base comprising a pair of spaced apart, parallel, and at least partially hollow members;

a lower perimeter frame comprising a pair of parallel outer lateral members and a pair of parallel longitudinal members, wherein said lower perimeter frame rests on said base;

a pair of uprights connected to said lower perimeter frame, each upright comprised of a vertically extending first member, a horizontally extending second member, a pair of parallel vertically extending third members and a fourth member comprised of a selective locking member;

a plurality of at least partially hollow vertically extending receiving elements connected to one of said longitudinal members;

at least one inner lateral member connected to said base;

an at least partially hollow rack connected to said at least one inner lateral member, said rack comprising vertically extending side members and at least one horizontally extending rail connecting the side members; and a pair of at least partially hollow stanchions connected to said at least one inner lateral member, said stanchions extending parallel to said vertically extending side members.

2. The rack apparatus of claim 1, wherein first and second ends of each of said base members are aligned with one another.

3. The rack apparatus of claim 1, wherein the pair of uprights and the pair of stanchions are each constructed of hollow members.

4. The rack apparatus of claim 1, wherein the horizontally extending second member is disposed on an end of the vertically extending first member.

5. The rack apparatus of claim 1, wherein the pair of parallel vertically extending third members are disposed at opposing distal first and second ends of the second member.

6. The rack apparatus of claim 1, wherein said selective locking member comprises a locking arm with a locker, wherein a first end of said locking arm is pivotally connected to one of the third members and a second end of said locking arm is releasably connected to another of the third members.

7. The rack apparatus of claim 1, wherein said at least one pair of uprights and another pair of stanchions are releasably secured to said lower perimeter frame and wherein said rack and said stanchions are releasably secured to said at least one inner lateral member.

8. The rack apparatus of claim 1, wherein said pair of parallel outer lateral members and said pair of parallel longitudinal members are coplanar and bound an open interior area, said pair of parallel outer lateral members and said pair of parallel longitudinal members are at least partially hollow.

9. The rack apparatus of claim 1, wherein said receiving elements are aligned in a linear array along said longitudinal member.

10. The rack apparatus of claim 9, wherein alternating receiving elements alternate in their vertical extension from the longitudinal member.

11. The rack apparatus of claim 1, wherein a locker is selectively engaged in an aperture in each of said receiving elements.

12. The rack apparatus of claim 1, wherein said at least one horizontally extending rail comprises a first horizontally extending rail and a second horizontally extending rail, wherein the first horizontally extending rail and the second horizontally extending rail connect the side members, wherein said rails and side members are coplanar, and said horizontally extending rails are parallel one another.

13. The rack apparatus of claim 1, wherein said at least one horizontal rail is provided with a least one arm cantilevered from said at least one horizontal rail, said arm having a curtailment member on an end portion thereof.

14. The rack apparatus of claim 1, wherein the at least one inner lateral member comprises a pair of inner lateral members, wherein said pair of inner lateral members are coplanar with one another and at least partially hollow, and are releasably coupled to the base.

15. A rack apparatus, comprising:

a base comprising a pair of at least partially hollow members;

a lower perimeter frame comprising a pair of parallel outer lateral members and a pair of parallel longitudinal members, wherein said lower perimeter frame rests on said base;

a pair of Y-shaped uprights connected to said lower perimeter frame, wherein at least one of said uprights has of a selective locking member;

a plurality of receiving elements connected to one of said longitudinal members;

at least one inner lateral member connected to said base;

a rack connected to said at least one inner lateral member, said rack comprising vertically extending side members and at least one horizontally extending rail connecting the side members; and a pair of stanchions connected to said at least one inner lateral member, said stanchions extending parallel to said vertically extending side members.

* * * * *